US008567931B2

(12) United States Patent
Takagi

(10) Patent No.: US 8,567,931 B2
(45) Date of Patent: Oct. 29, 2013

(54) INK CARTRIDGE SUPPRESSING INTERNAL PRESSURE INCREASE AT THE TIME OF INSTALLATION

(75) Inventor: Yuki Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 219 days.

(21) Appl. No.: 13/004,865

(22) Filed: Jan. 11, 2011

(65) Prior Publication Data

US 2011/0310194 A1 Dec. 22, 2011

(30) Foreign Application Priority Data

Jun. 17, 2010 (JP) ..... 2010-137812

(51) Int. Cl.
*B41J 2/175* (2006.01)

(52) U.S. Cl.
USPC ..... 347/86; 347/7; 347/85; 347/87; 347/92; 347/102

(58) Field of Classification Search
None
See application file for complete search history.

(56) References Cited

U.S. PATENT DOCUMENTS 5,300,958 A * 4/1994 Burke et al. ..... 347/28
5,485,187 A * 1/1996 Okamura et al. ..... 347/85
5,812,168 A * 9/1998 Pawlowski et al. ..... 347/92
5,900,896 A 5/1999 Barinaga et al.
5,903,294 A * 5/1999 Abe et al. ..... 347/87
6,276,785 B1 * 8/2001 Shinada et al. ..... 347/86
7,240,999 B2 * 7/2007 Kumagai et al. ..... 347/85
7,784,930 B2 * 8/2010 Miyazawa et al. ..... 347/102
2007/0070151 A1 3/2007 Hattori et al.
2008/0049082 A1 2/2008 Hattori et al.
2008/0297576 A1 12/2008 Hattori et al.
2009/0021565 A1 1/2009 Hattori
2011/0164077 A1 * 7/2011 Masunaga ..... 347/6

FOREIGN PATENT DOCUMENTS

JP H09-187960 A 7/1997
JP 2007-144811 A 6/2007
JP 2009-023103 A 2/2009

* cited by examiner

*Primary Examiner* — Matthew Luu
*Assistant Examiner* — John P Zimmermann
(74) *Attorney, Agent, or Firm* — Baker Botts L.L.P.

(57) ABSTRACT

There is provided an ink cartridge including a first ink chamber, a second ink chamber, an ink-flow check portion and a pressure control portion. The first ink chamber is configured to store ink therein. The second ink chamber is in fluid communication with the first ink chamber via a first path, the second ink chamber defining therein a volume. The ink-flow check portion is configured to allow the ink to flow from the first ink chamber to the second ink chamber and block the ink from flowing from the second ink chamber to the first ink chamber. The pressure control portion is configured to control an internal pressure of the second ink chamber.

24 Claims, 12 Drawing Sheets

INK CARTRIDGE SUPPRESSING INTERNAL PRESSURE INCREASE AT THE TIME OF INSTALLATION

CROSS REFERENCE TO RELATED APPLICATION

This application claims priority from Japanese Patent Application No. 2010-137812 filed Jun. 17, 2010. The entire content of the priority application is incorporated herein by reference.

TECHNICAL FIELD

The present invention relates to an ink cartridge insertable into an image recording apparatus provided with a hollow needle for allowing ink to flow outside of the ink cartridge via the needle.

BACKGROUND

In a known ink-jet recording apparatus, ink is supplied from an ink cartridge to a recording head via a tube. The ink-jet recording apparatus is provided with a cartridge installation portion on which the ink cartridge is detachably installable. When installed, the ink cartridge is connected to the recording head via the tube, thereby forming an ink passage between the ink cartridge and the recording head.

The ink cartridge includes an ink chamber for storing ink, an ink supplying section for allowing the ink to be supplied to outside via a valve or a seal, and a path connecting the ink chamber and the ink supplying section. The ink supplying section is provided with an accommodation chamber for accommodating the valve or the seal. When the ink cartridge is installed in the cartridge installation portion, a hollow needle provided in the cartridge installation portion is inserted into the accommodation chamber to move the valve or to break the seal, whereupon the ink can be supplied to the hollow needle. Further, a check valve is provided in the path in order to block the ink from flowing back into the ink chamber from the ink supplying section.

SUMMARY

When the hollow needle is inserted into the accommodation chamber, the ink within the accommodation chamber is pushed by an amount equal to a volume of the inserted hollow needle, thereby causing pressure within the accommodation chamber to increase. In response, the ink tries to flow either into the ink chamber or to outside. At this time, due to the check valve positioned in the path, the ink is not able to flow into the ink chamber but flows into the recording head via the hollow needle. The recording head is provided on a carriage having a sub tank whose portion is made up of a deformable film. When the ink flows into the sub tank, the film of the sub tank deforms and absorbs a pressure change that occurs within the sub tank. While the deformed film restores its original shape, the ink flows back from the sub tank to the accommodation chamber.

If the ink cartridge is removed from the cartridge installation portion during the period in which the ink flows out of the accommodation chamber and then comes back thereto from the sub tank, the ink, which is supposed to go back to the accommodation chamber, may be dripping down from the needle. In this case, the fallen ink could contaminate the cartridge installation portion and adhere to an outer casing of ink cartridge. Further, the ink deposited on the outer casing of the ink cartridge could scatter around a circuit board of the recording apparatus when the ink cartridge is being installed in/removed from the cartridge installation portion, which may possibly cause an electrical trouble and corrosion.

In view of the foregoing, it is an object of the present invention to provide an ink cartridge capable of suppressing an amount of ink flowing to a recording head of a recording apparatus at the time of installation of the ink cartridge in the recording apparatus.

In order to attain the above and other objects, the present invention provides an ink cartridge including a first ink chamber, a second ink chamber, an ink-flow check portion and a pressure control portion. The first ink chamber is configured to store ink therein. The second ink chamber is in fluid communication with the first ink chamber via a first path, the second ink chamber defining therein a volume. The ink-flow check portion is configured to allow the ink to flow from the first ink chamber to the second ink chamber and block the ink from flowing from the second ink chamber to the first ink chamber. The pressure control portion is configured to control an internal pressure of the second ink chamber.

According to another aspect of the present invention, there is provided an image recording apparatus including an ink cartridge, a needle, a fourth ink chamber and a recording head. The ink cartridge includes a first ink chamber configured to store ink therein; a second ink chamber that is in fluid communication with the first ink chamber via a first path, the second ink chamber having an outlet port, and the second ink chamber defining therein a volume; an ink-flow check portion configured to allow the ink to flow from the first ink chamber to the second ink chamber and block the ink from flowing from the second ink chamber to the first ink chamber; and a pressure control portion configured to control an internal pressure of the second ink chamber. The needle is configured to be inserted into the outlet port of the second ink chamber. The fourth ink chamber is configured to store the ink flowing out of the second ink chamber via the needle, the fourth ink chamber defining therein a volume that is allowed to change in accordance with a change in the internal pressure of the second ink chamber. The ink is then supplied from the fourth ink chamber to the recording head.

DETAILED DESCRIPTION

An ink cartridge 30 according to a first embodiment of the present invention will be described with reference to FIGS. 1 through 9.

Figure 1:
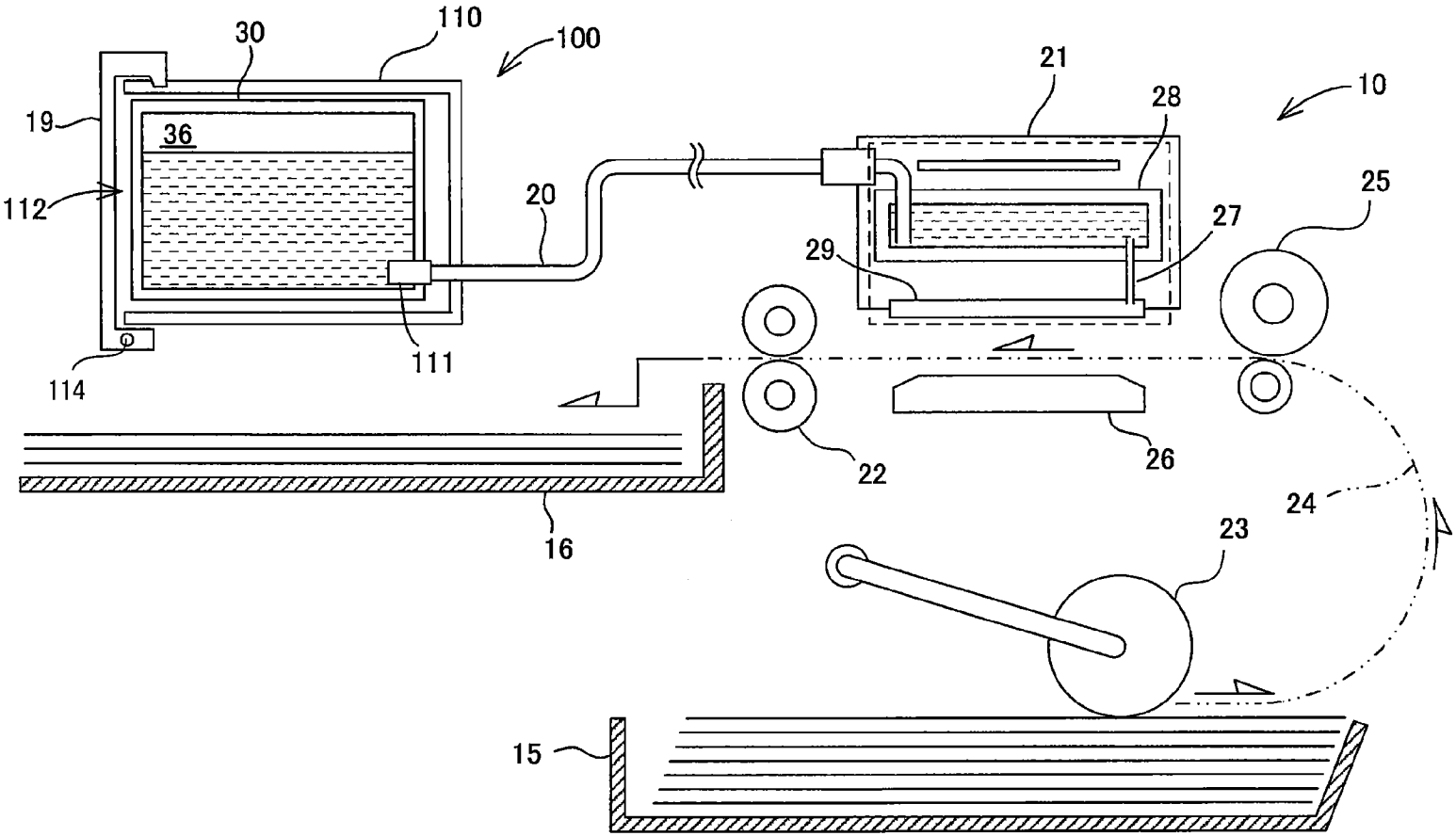
FIG. 1 is a cross-sectional diagram conceptually illustrating an internal structure of a printer incorporating an ink cartridge according to a first embodiment of the present invention.

First, a general configuration of a printer 10 in which the ink cartridge 30 is accommodated will be described with reference to FIG. 1. The terms "upward", "downward", "upper", "lower", "above", "below", "beneath", "right", "left", "front", "rear" and the like will be used throughout the description assuming that the printer 10 is disposed in an orientation in which it is intended to be used.

The printer 10 is a color ink-jet recording apparatus that forms an image on a recording medium (a sheet of paper in the present embodiment) by selectively ejecting ink droplets. The printer 10 includes an ink supplying unit 100, a carriage 21 and four ink tubes 20 connecting therebetween in correspondence with four colors of ink, as shown in FIG. 1. For simplicity, only one ink tube 20 is depicted in FIG. 1.

The ink supplying unit 100 includes a cartridge case 110 adapted for detachably accommodating four kinds of ink cartridges 30. Each ink cartridge 30 stores ink of one of four colors: cyan, magenta, yellow and black. The cartridge case 110 is formed with an opening 112 through which the four ink cartridges 30 are loaded into or unloaded from the cartridge case 110 in a substantially horizontal direction (i.e., a left-to-right direction in FIG. 1).

The opening 112 is covered with a cover 19 that is pivotably movably supported to a frame (not shown) of the printer 10. The cover 19 is pivotally movable about a shaft 114 provided at a lower end of the opening 112 to open and close the opening 112.

The cartridge case 110 has an end wall on which four ink needles 111 are provided. Each ink needle 111 is a tubular-shaped silicon member, protruding toward the opening 112 of the cartridge case 110. Each ink needle 111 has one end connected to the corresponding ink tube 20 and another end on which a cut-out 113 is formed (see FIGS. 8 and 9). The ink needle 111 is formed with an internal space that extends through the ink needle 111. When the ink cartridge 30 is installed in the cartridge case 110, the corresponding ink needle 111 is inserted into the ink cartridge 30, whereupon the ink within the ink cartridge 30 flows into the ink needle 111 via the cut-out 113. The ink is then supplied to a corresponding sub tank 28 (described next) provided in the carriage 21 via the ink tube 20 of the corresponding color.

The carriage 21 includes a recording head 29 and four sub tanks 28 each corresponding to one of the four colors. The each sub tank 28 temporarily stores ink of the corresponding color supplied from the ink cartridge 30 of the same color via the corresponding ink tube 20. The recording head 29 is connected to each sub tank 28 via an ink passage 27 provided in correspondence with each sub tank 28. The recording head 29 is thus connected to each ink cartridge 30 via the corresponding ink needle 111, ink tube 20, sub tank 28 and ink passage 27. The recording head 29 selectively ejects the ink supplied from the ink cartridges 30 in a form of fine ink droplet.

Each sub tank 28 has an upper wall made of a deformable flexible film. This flexibility of the film enables a volume of the sub tank 28 to change, thereby absorbing pressure changes within the sub tank 28.

The printer 10 also includes a sheet supply tray 15, a sheet supply roller 23, a sheet passage 24, a pair of conveyor rollers 25, a platen 26, a pair of discharge rollers 22, and a discharge tray 16 arranged in this order in a sheet feeding direction. The sheet supplied from the sheet supply tray 15 to the sheet passage 24 by the sheet supply roller 23 is conveyed to the platen 26 by the pair of conveyor rollers 25. When the sheet is placed on the platen 26, the recording head 29 selectively ejects ink onto the sheet while moving back and forth, along with the carriage 21, in two linear directions that are perpendicular to the sheet feeding direction and parallel to the surface of the sheet. In this way, images are formed on the sheet. Then, the ink is selectively ejected from the recording head 29 onto the sheet passing through the platen 26 to form an inked image on the sheet. The sheet is then discharged onto the discharge tray 16 by the pair of discharge rollers 22.

Next, a detailed configuration of the ink cartridge 30 according to the first embodiment will be explained with reference to FIGS. 2 through 9.

Figure 2:
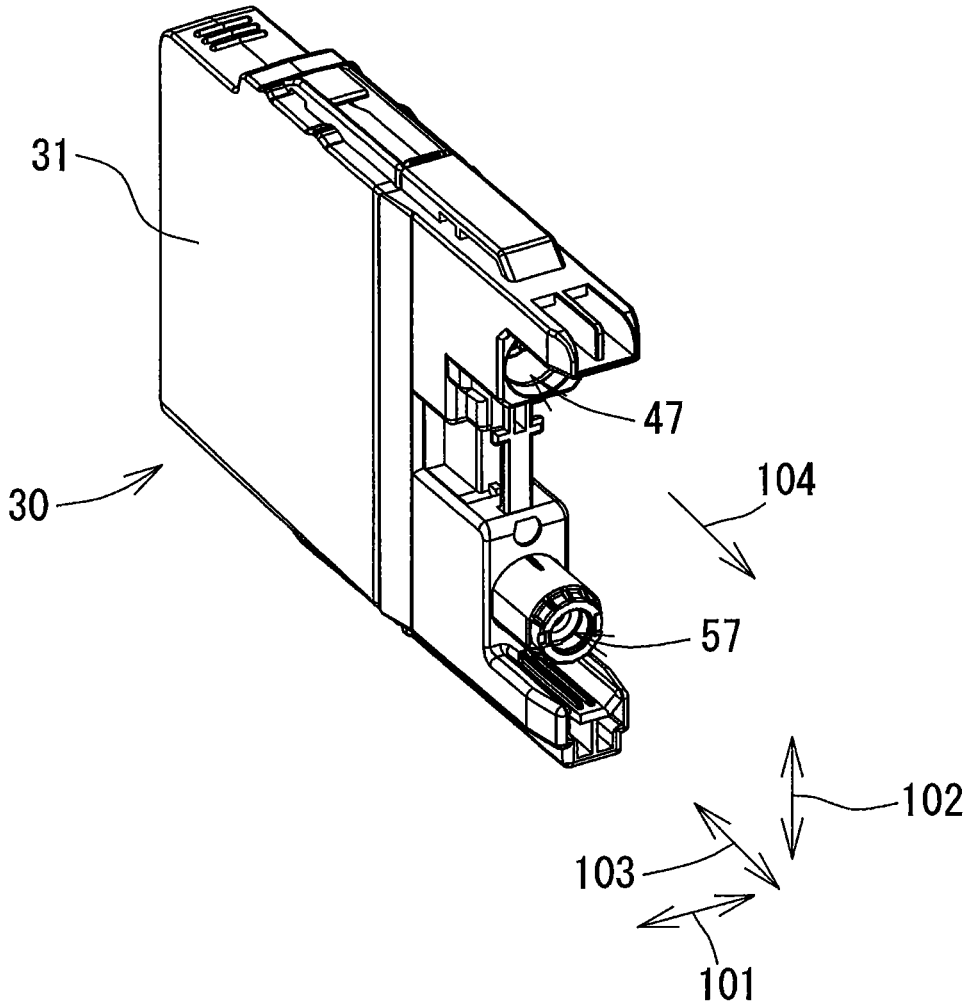
FIG. 2 is a perspective view showing an exterior of the ink cartridge according to the first embodiment.

The ink cartridge 30 is a container for storing ink therein. The ink cartridge 30 is loaded into the cartridge case 110 in a direction indicated by an arrow 104 as shown in FIG. 2 (to be referred to as "insertion direction"). When installed in the cartridge case 110, the ink cartridge 30 is held in an upright posture shown in FIG. 2. Each ink cartridge 30 has a shape identical to one another except that each accommodates ink of a different color.

The ink cartridge 30 has a substantially flat parallelepiped shape. In the upright posture shown in FIG. 2, the ink cartridge 30 has a small width (in a direction indicated by an arrow 101 which will be referred to as widthwise direction or horizontal direction), a height (in a direction indicated by an arrow 102 which will be referred to as a vertical direction that is perpendicular to the widthwise direction) and a depth (in a direction indicated by an arrow 103 which will be referred to as a depthwise direction which is perpendicular to the widthwise direction and the vertical direction) those greater than the width. The ink cartridge 30 has an outer casing 31 within which an internal structure of the ink cartridge 30 is accommodated.

Figure 3:
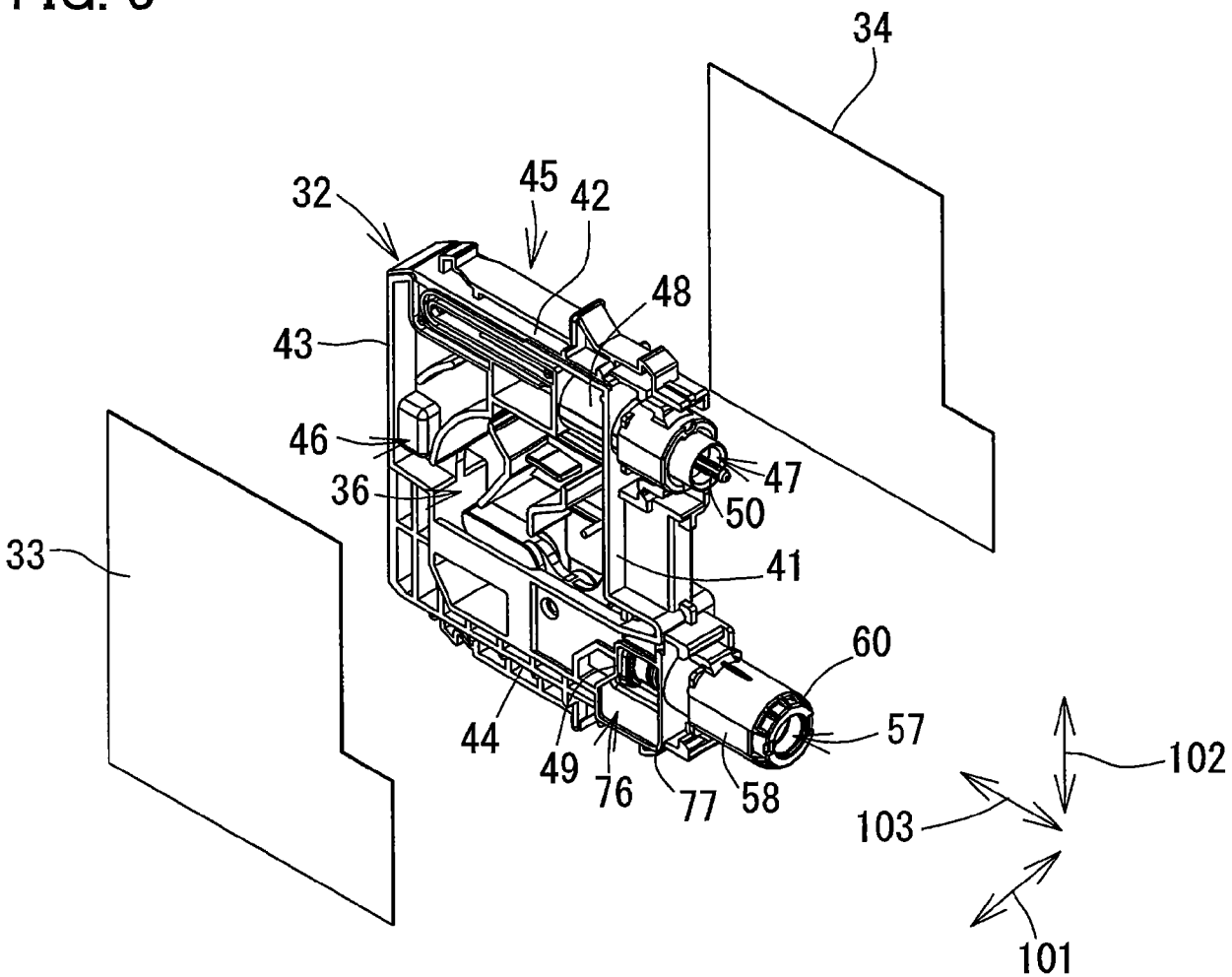
FIG. 3 is a perspective view showing an internal structure of the ink cartridge according to the first embodiment.
Figure 4:
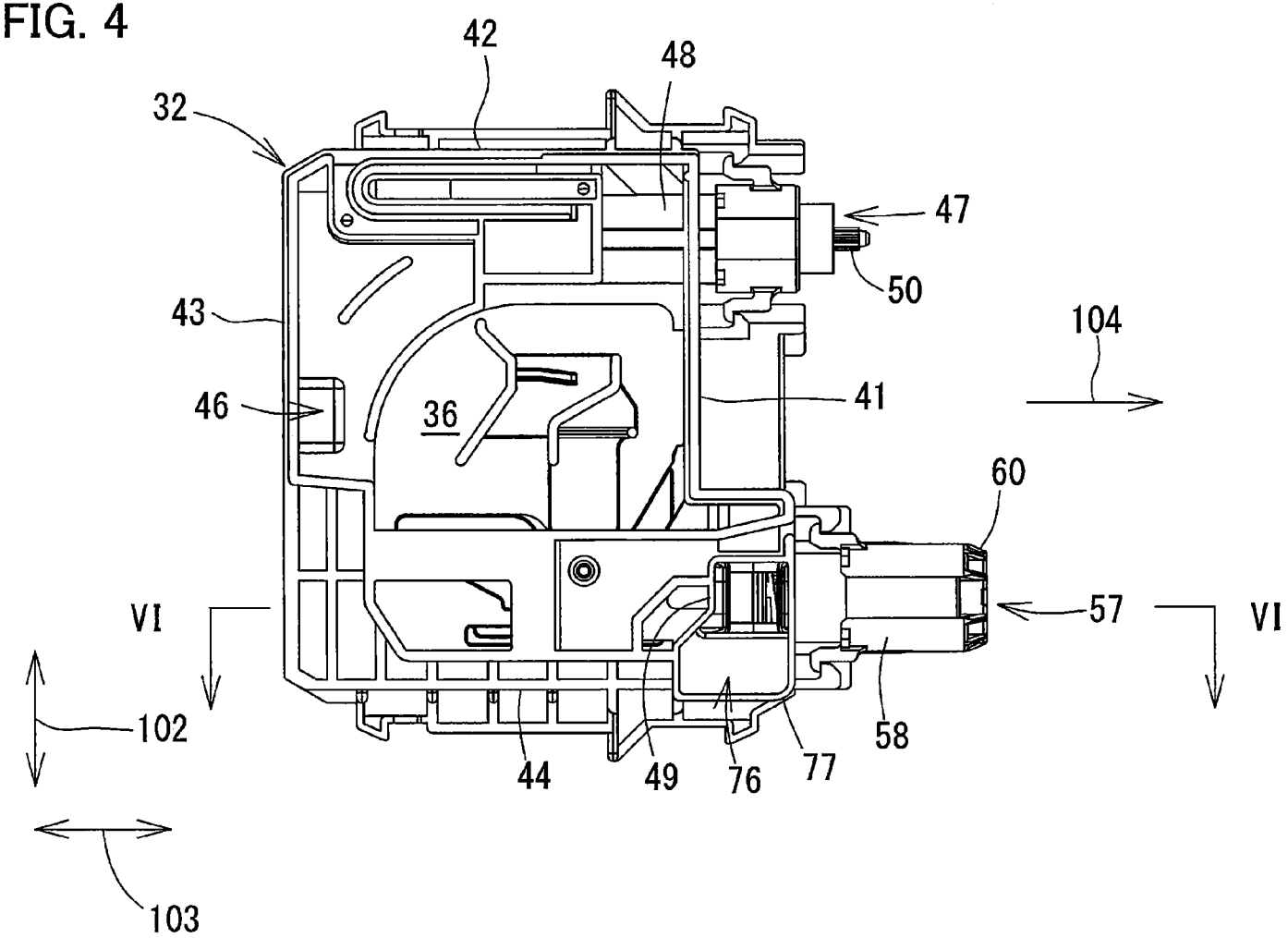
FIG. 4 is a right side view of the internal structure of the ink cartridge according to the first embodiment.
Figure 5:
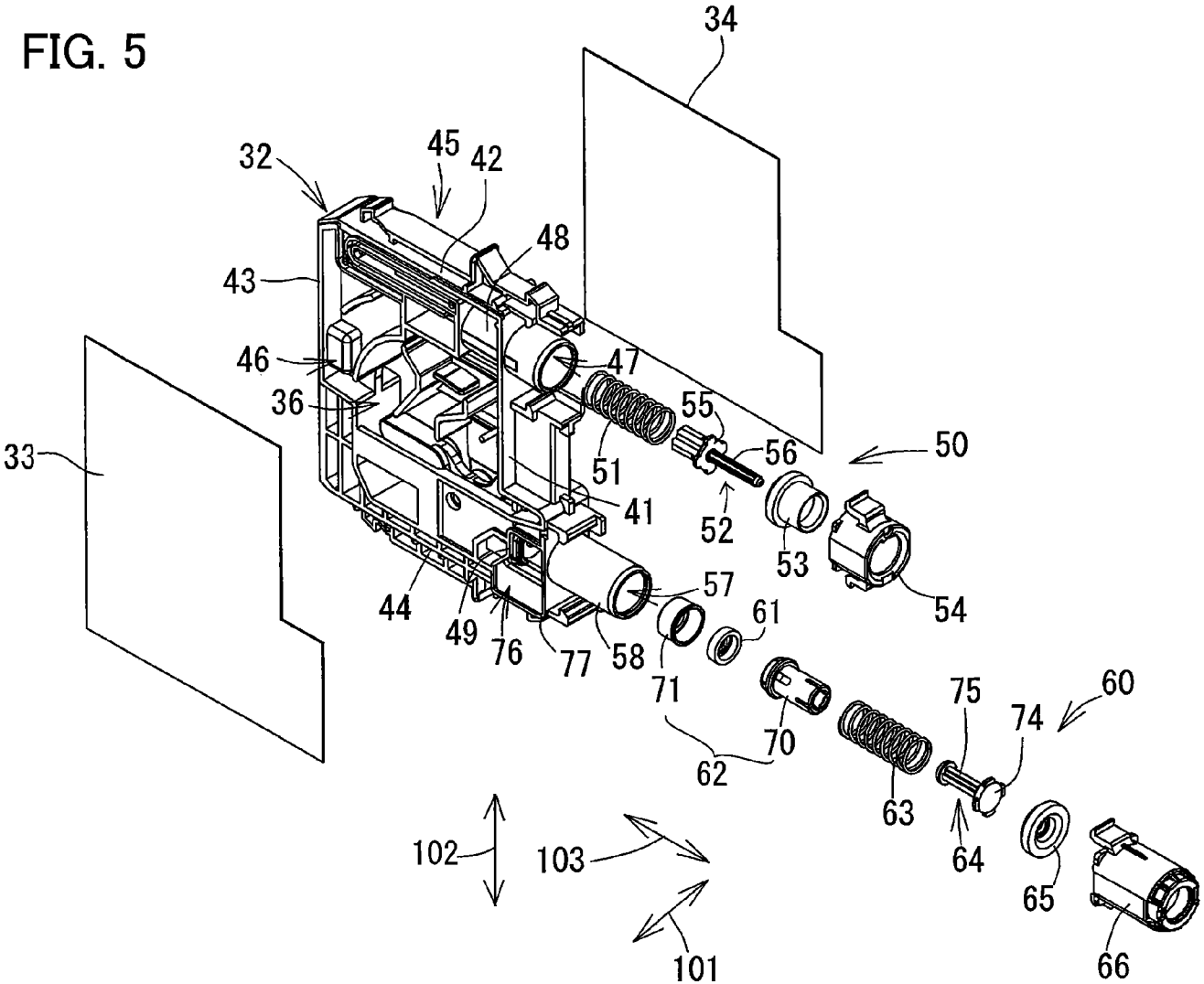
FIG. 5 is an exploded perspective view showing the internal structure of the ink cartridge according to the first embodiment.

As shown in FIGS. 3 through 5, the internal structure of the ink cartridge 30 includes a frame 32, an air communication valve 50, an ink supply valve 60 and films 33, 34. The frame 32 and the films 33, 34 define an ink chamber 36 for accommodating ink therein. A detailed structure provided within the ink chamber 36 (for example, ribs for maintaining rigidity and a mechanism for detecting an amount of ink) will not be described here for the sake of simplification.

The frame 32 is formed of a synthetic resin capable of transmitting light emitted from a light sensor, such as infrared ray. The frame 32 may be formed of any types of resin, such as a transparent or translucent resin, provided that the resin has a light-transmissive capability. For example, polyacetal, nylon, polyethylene or polypropylene is available.

The frame 32 has a front wall 41, an upper wall 42, a rear wall 43 and a bottom wall 44. As shown in FIGS. 3 through 5, the front wall 41, the upper wall 42, the rear wall 43 and the bottom wall 44 integrally form a substantially tubular shape so that the frame 32 is formed with a right surface 46 and a left surface 45 each having an opening therein.

The films 33, 34 are made of a thin-walled transparent resin, and have a flexible, stretchable or elastically deformable characteristic. The films 33, 34 are respectively attached to the right surface 46 and the left surface 45 of the frame 32, more specifically, to peripheral portions of the right surface 46 and the left surface 45 by ultrasonic welding. Alternatively, the films 33, 34 may be thermally welded to the frame 32. The films 33, 34 thus close the openings formed in the right surface 46 and the left surface 45 respectively. A space bounded by the frame 32 and the films 33, 34 is defined as the ink chamber 36.

In the first embodiment, the ink chamber 36 is formed such that the films 33, 34 cover the openings formed on both of the left surface 45 and the right surface 46 of the frame 32. However, the frame 32 may be formed into a box shape having only one opening formed on either one of the left surface 45 and the right surface 46. In this case, the sole opening is covered by a film to define the ink chamber 36 within the frame 32.

An air valve accommodation chamber 48 is formed on the front wall 41 of the frame 32 at a position adjacent to the upper wall 42, as shown in FIGS. 3 through 5. The air valve accommodation chamber 48 protrudes frontward in the insertion direction 104 and has a cylindrical shape. The air valve accommodation chamber 48 has a tip end portion on which a circular-shaped air outlet port 47 is formed. The air valve accommodation chamber 48 also has a portion that protrudes inward of the frame 32. The air valve accommodation chamber 48 has a depth end opposite to the air outlet port 47 that is in communication with the ink chamber 36. The air valve accommodation chamber 48 accommodates the air communication valve 50 therein.

As shown in FIG. 5, the air communication valve 50 is a valve mechanism to open and close an air-flow passage formed between the air outlet port 47 and the ink chamber 36 (specifically, an air confined in the ink chamber 36). The air communication valve 50 includes a compression spring 51, a valve main body 52, a sealing member 53 and a cap 54, each of which is formed of a resin such as polyacetal and silicon rubber. The compression spring 51 and the valve main body 52 are accommodated within the air valve accommodation chamber 48, while the sealing member 53 and the cap 54 are assembled so as to be coaxially aligned with the air outlet port 47.

More specifically, the valve main body 52 is disposed within the air valve accommodation chamber 48 so as to be movable in the depthwise direction 103. The valve main body 52 includes a lid 55 and a rod 56. The rod 56 extends from a center of the lid 55, passing through the center of the air outlet port 47, and protrudes outward of the air outlet port 47. The sealing member 53 and the cap 54 are respectively formed with a through-hole at a center thereof through which the rod 56 penetrates. When assembled, the rod 56 is exposed to outside of the air valve accommodation chamber 48 via the air outlet port 47.

The compression spring 51 biases the valve main body 52 toward the sealing member 53 such that the lid 55 is pressed against the sealing member 53. Therefore, the lid 55 is in intimate contact with the sealing member 53. With this structure, the air communication valve 50 normally serves to close the air-flow passage between the air valve accommodation chamber 48 and the atmosphere (outside of the ink cartridge 30).

While the ink cartridge 30 is being inserted into the cartridge case 110, the rod 56 is pushed toward the depth end of the air valve accommodation chamber 48 (toward the ink chamber 36) to separate the lid 55 from the sealing member 53 against the biasing force of the compression spring 51. As a result, the air-flow passage is opened for introducing air from outside into the ink chamber 36 through the air valve accommodation chamber 48. At this time, due to the air flowing into the ink chamber 36, the inner pressure within the ink chamber 36 becomes equal to the atmospheric pressure. The air communication valve 50 may not necessarily be provided if the ink chamber 36 is maintained to have negative pressure therewithin. Further, instead of the air communication valve 50, at least a passage may be provided for allowing air communication between the ink chamber 36 and the atmosphere.

On the front wall 41 of the frame 32, an ink valve accommodation chamber 58 is also formed at a position adjacent to the bottom wall 44. The ink valve accommodation chamber 58 protrudes frontward in the insertion direction 104 and is of a cylindrical shape. The ink valve accommodation chamber 58 has a tip end portion on which a circular-shaped ink outlet port 57 is formed. The ink valve accommodation chamber 58 also has a portion that protrudes inward of the frame 32 (toward the ink chamber 36). The ink valve accommodation chamber 58 has a depth end opposite the ink outlet port 57 that is in communication with the ink chamber 36. The ink valve accommodation chamber 58 accommodates the ink supply valve 60 therein.

Figure 6:
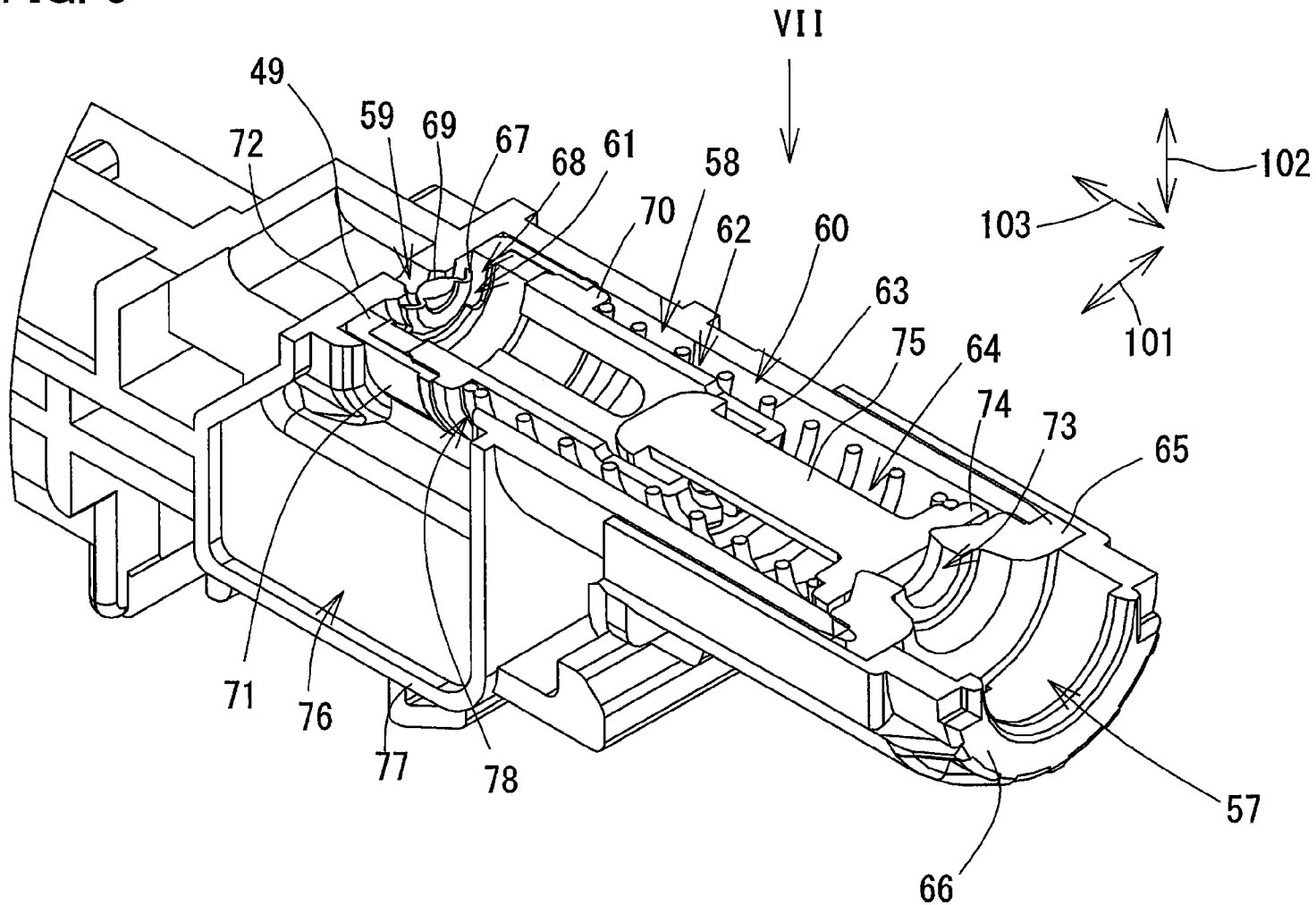
FIG. 6 is a partially enlarged perspective view showing a cross-section of the ink cartridge according to the first embodiment taken along a plane including a line VI-VI shown in FIG. 4.
Figure 7:
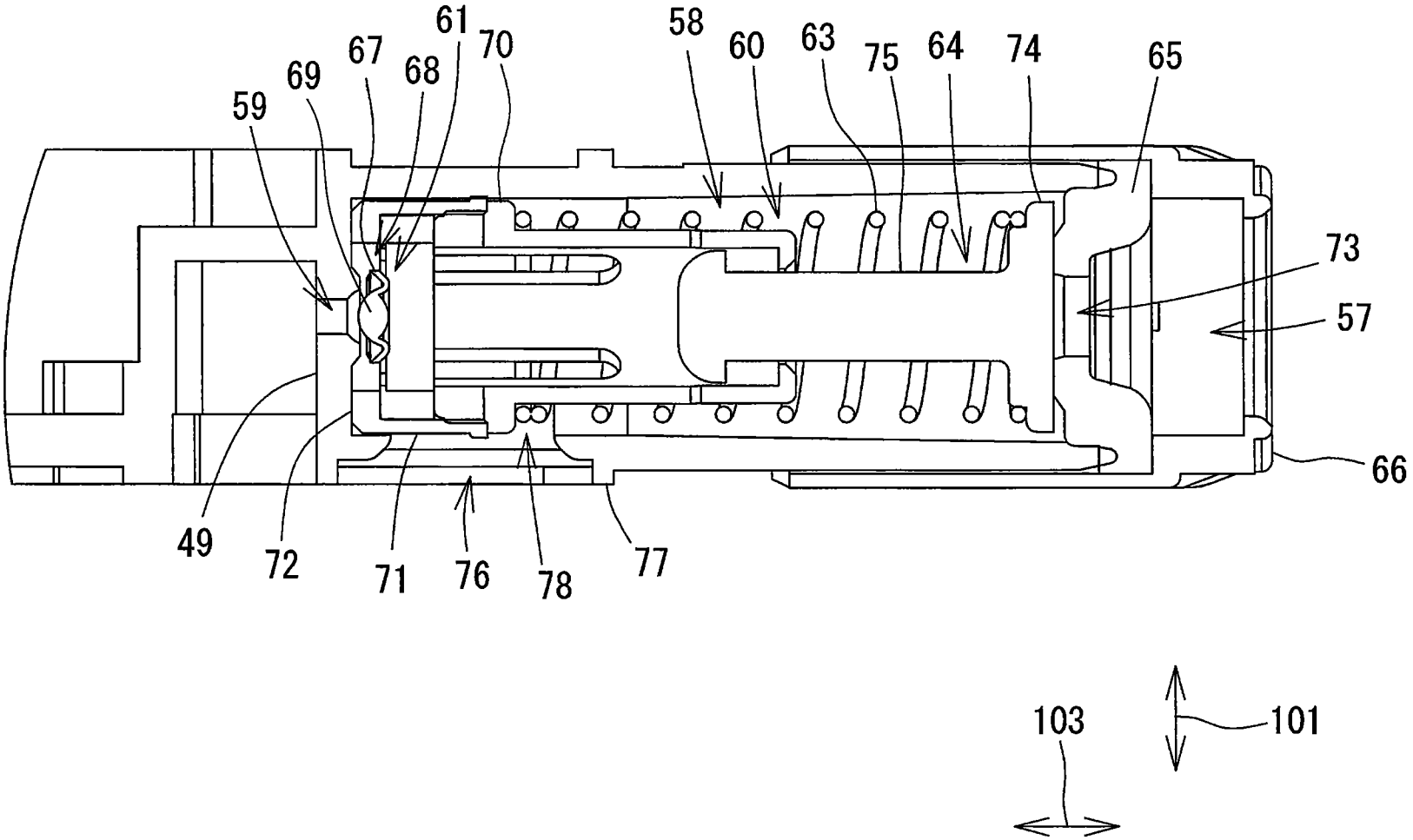
FIG. 7 is a plan view of a cross-section of a valve accommodation chamber of the ink cartridge of FIG. 6 as viewed from a direction VII shown in FIG. 6.

More specifically, as shown in FIGS. 6 and 7, a partitioning wall 49 is formed between the depth end of the ink valve accommodation chamber 58 and the ink chamber 36. The partitioning wall 49 is formed with a through-hole 59 for introducing ink from the ink chamber 36 into the ink valve accommodation chamber 58. The ink supply valve 60 is a valve mechanism that serves to open and close the through-hole 59. The ink valve accommodation chamber 58 is allowed to be in communication with the ink chamber 36 via the through-hole 59 when the ink supply valve 60 opens the through-hole 59. The through-hole 59 is therefore to be referred to as "ink-flow passage 59."

As shown in FIG. 5, the ink supply valve 60 includes a valve member 61, a valve seat 62, a compression spring 63, a valve main body 64, a sealing member 65 and a cap 66, each of which is formed of a resin, for example, polyacetal and silicon rubber. The valve member 61, the valve seat 62, the compression spring 63 and the valve main body 64 are accommodated within the ink valve accommodation chamber 58, while the sealing member 65 and the cap 66 are coaxially assembled to the ink outlet port 57.

Figure 8:
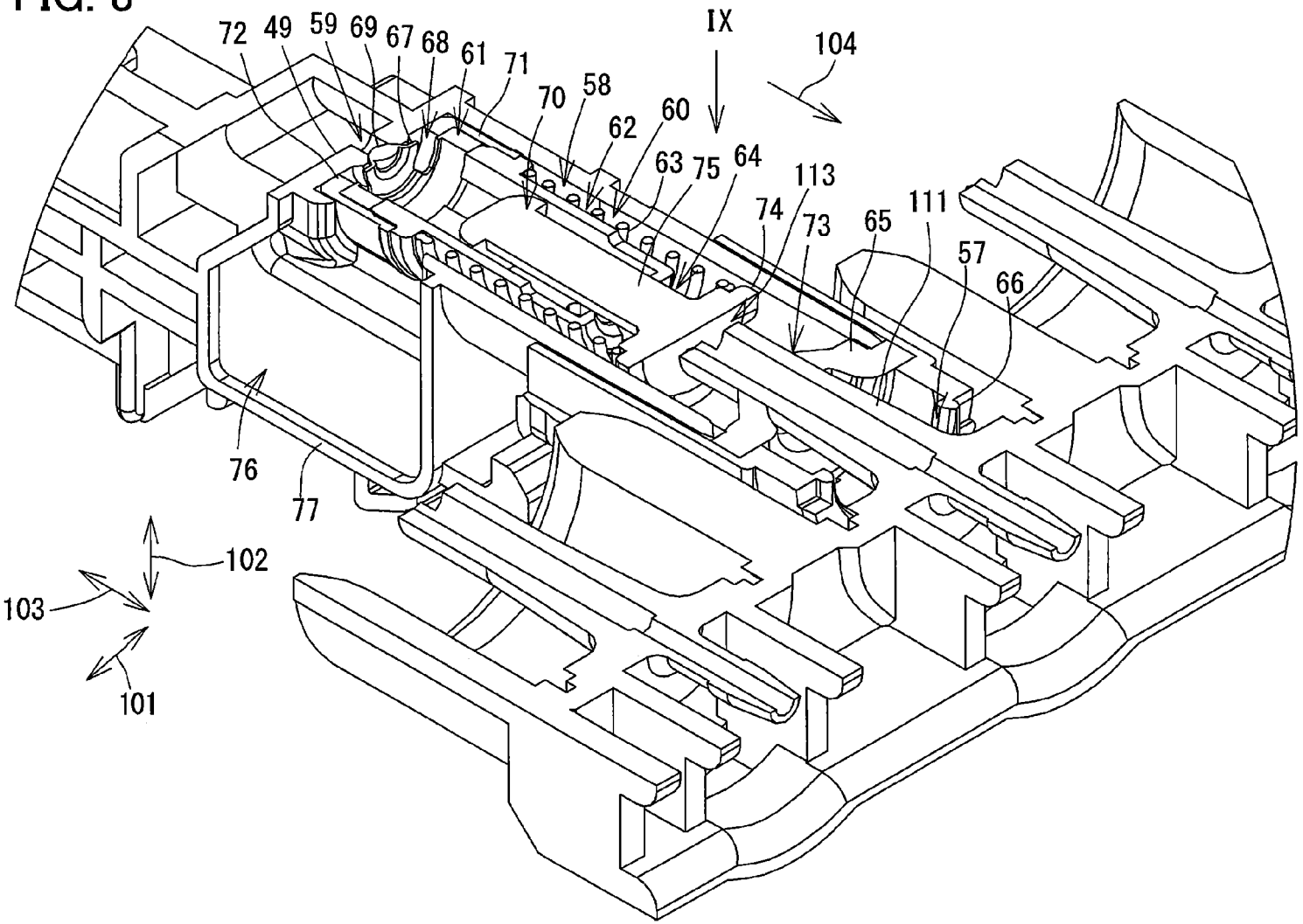
FIG. 8 is an enlarged perspective view showing the cross-section of the valve accommodation chamber according to the first embodiment, in which an ink needle is inserted into the valve accommodation chamber.

As shown in FIG. 6, the valve member 61 is positioned on the depth end of the ink valve accommodation chamber 58. While being coupled to the valve seat 62, the valve member 61 is elastically deformable such that the valve member 61 can be in contact with or in separation from the partitioning wall 49. In other words, the valve member 61 serves as a check valve for opening or closing the ink-flow passage 59 formed on the partitioning wall 49. The valve member 61 is made of a silicon rubber, for example, and is formed by injection molding. The valve member 61 is a ring-shaped or hollow member having two opposing openings. One of the openings is in confrontation with the valve seat 62, while the other opening faces the depth end of the ink valve accommodation chamber 58. The depth-side opening of the valve member 61 is substantially covered with a wall 67. More specifically, as shown in FIGS. 6 through 8, the depth-side opening of the valve member 61 is not totally covered with the wall 67 since the wall 67 is formed with a through-hole 68 that allows ink to flow therethrough. The wall 67 further has a central portion on which a hemispherical section 69 is formed. In accordance with elastic deformation of the wall 67, the hemispherical section 69 is urged to move so as to open and close the ink-flow passage 59 of the partitioning wall 49.

The valve seat 62 has a tubular shape. The valve seat 62 accommodates therewithin the valve member 61 and is coupled to the valve member 61. The valve seat 62 is formed of a resin, such as polypropylene, by using injection molding. The valve seat 62 includes a base member 70 and a receiving member 71. The base member 70 has a tubular shape and penetrates through the compression spring 63 so as to be engaged with the same. The base member 70 also supports the valve main body 64 such that the valve main body 64 is slidably movable within the base member 70 in the depthwise direction 103.

The receiving member 71 is coupled to an end of the base member 70, the end facing the valve member 61. The receiving member 71 has a cylindrical shape to be fittingly accommodated in the ink valve accommodation chamber 58. The receiving member 71 has a depth end on which a flange portion 72 is formed, the depth end being in contact with the partitioning wall 49. The flange portion 72 protrudes radially inward from the receiving member 71. The flange portion 72 enables the valve member 61 to be positioned between the receiving member 71 and the base member 70.

When the ink supply valve 60 is assembled, the receiving member 71 is tightly pressed against the partitioning wall 49 due to the biasing force of the compression spring 63. The receiving member 71 between the valve member 61 and the partitioning wall 49 allows a space to be formed therebetween, thereby enabling the hemispherical section 69 to separate from the ink-flow passage 59 (in this state, the hemispherical section 69 is at its original position). In other words, the valve member 61 opens the ink-flow passage 59. As a result, the ink accommodated within the ink chamber 36 is allowed to flow into the ink valve accommodation chamber 58 through the ink-flow passage 59 and the through-hole 68 of the valve member 61.

When the ink flows into the ink chamber 36 from the ink valve accommodation chamber 58, the wall 67 of the valve member 61 elastically deforms toward the partitioning wall 49, which causes the hemispherical section 69 to be in intimate contact with the ink-flow passage 59. The ink-flow passage 59 is therefore closed, preventing the ink from flowing back to the ink chamber 36 from the ink valve accommodation chamber 58. When the ink is not allowed to flow into the ink chamber 36 from the ink valve accommodation chamber 58, the hemispherical section 69 moves back to the original position due to the elastic force of the valve member 61 and separates from the ink-flow passage 59. In this way, the valve member 61 serves as a check valve for allowing ink to flow into the ink valve accommodation chamber 58 from the ink chamber 36, as well as for preventing ink from flowing back to the ink chamber 36 from the ink valve accommodation chamber 58.

As shown in FIGS. 6 and 7, the compression spring 63 is disposed between the base member 70 and the valve main body 64 in a compressed state. The compression spring 63 biases the base member 70 and the receiving member 71 toward the partitioning wall 49, whereas biasing the valve main body 64 toward the sealing member 65.

The valve main body 64 includes a disc-shaped portion 74 and a rod-like portion 75, as shown in FIGS. 6 and 7. The disc-shaped portion 74 is disposed in opposition to the sealing member 65 and in intimate contact therewith due to the biasing force of the compression spring 63. The rod-like portion 75 protrudes from the disc-shaped portion 74, and is inserted into an internal space formed within the base member 70. The base member 70 serves to guide movement of the rod-like portion 75 in the depthwise direction 103 so that the disc-shaped portion 74 can slidably move so as to be in separation from and in contact with the sealing member 65.

The sealing member 65 is fitted to the ink outlet port 57 due to the cap 66. The sealing member 65 is formed of an elastically deformable resin, such as rubber, to have a high sealing performance. The sealing member 65 has a disk-like shape and is formed with a through-hole 73 at a center thereof. When the sealing member 65 is tightly pressed against the valve main body 64 (the disc-shaped portion 74), the through-hole 73 is closed. When the valve main body 64 separates from the sealing member 65 against the biasing force of the compression spring 63, the through-hole 73 is opened. The sealing member 65 and the disc-shaped portion 74 define a portion of the ink valve accommodation chamber 58.

The valve main body 64 separates from the sealing member 65 when the ink needle 111 is inserted into the through-hole 73 for installation of the ink cartridge 30 into the cartridge case 110. In other words, when the ink cartridge 30 is loaded, the through-hole 73 is opened for enabling the ink to flow out of the ink valve accommodation chamber 58.

Since a gap or space is formed between each component of the ink supply valve 60, ink flowing into the ink valve accommodation chamber 58 is allowed to reach the sealing member 65 through the ink supply valve 60. When the through-hole 73 of the sealing member 65 is opened, the ink within the ink valve accommodation chamber 58 is released to outside. The through-hole 73 has a diameter smaller than that of an outer circumferential surface of the ink needle 111. Hence, when the ink needle 111 is inserted into the through-hole 73, the outer circumferential surface of the ink needle 111 is elastically brought into tight contact with the through-hole 73. This configuration can prevent the ink from leaking between the through-hole 73 and the ink needle 111.

Figure 9:
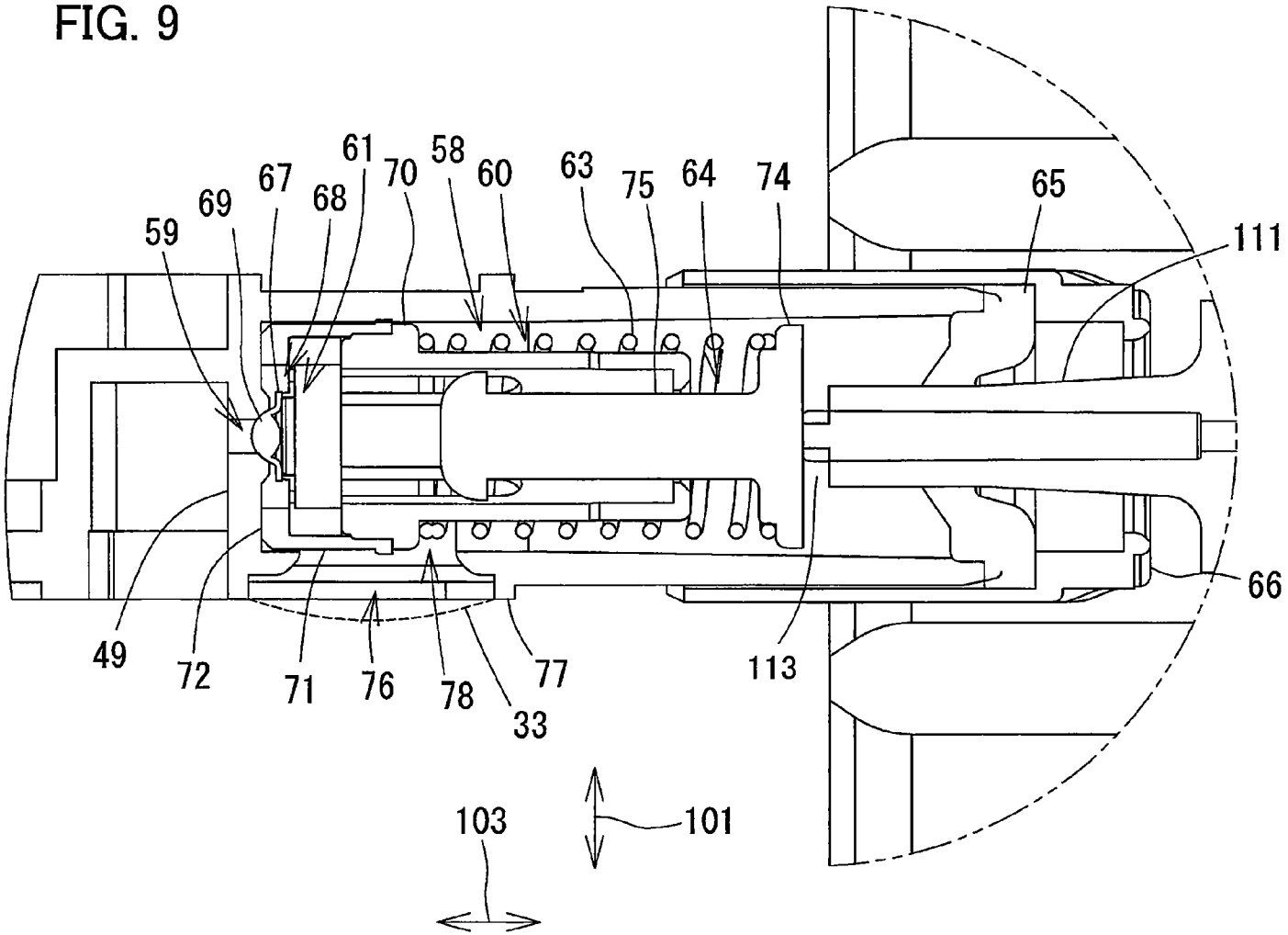
FIG. 9 is a plan view of the cross-section of the valve accommodation chamber of FIG. 8 as viewed from a direction IX shown in FIG. 8.

As shown in FIGS. 6, 7 and 9, the ink valve accommodation chamber 58 is formed with an opening 78 on a wall facing the right surface 46 of the frame 32. Through the opening 78, the ink valve accommodation chamber 58 is in communication with a space 76 that opens toward the right surface 46. The space 76 extends downward from the ink valve accommodation chamber 58, and is bounded by a periphery 77 that constitutes the right surface 46 of the frame 32 together with the front wall 41, the upper wall 42, the rear wall 43 and the bottom wall 44 (also see FIG. 4). The periphery 77 is covered with the film 33 by ultrasonic welding to close the space 76. The space 76 is thus provided with a flat surface formed of the film 33. This surface of the space 76 has an area greatest among other flat surfaces constituting the space 76. The space 76 and the ink valve accommodation chamber 58 thus integrally serve as a secondary ink chamber for temporarily storing ink therein. With provision of the deformable film 33 as the largest flat surface, this secondary ink chamber is allowed to have an expandable volume. More specifically, as indicated by a broken line in FIG. 9, the film 33 can deform such that the volume of the secondary ink chamber can increase, i.e., the film 33 can deform outward so as to expand the volume of the secondary ink chamber.

Upon insertion of the ink needle 111 into the through-hole 73, the ink flows into the internal space of the ink needle 111 via the cut-out 113 of the ink needle 111. When the ink needle 111 enters into the ink valve accommodation chamber 58, the valve main body 64, which has closed the through-hole 73, is separated from the sealing member 65 against the biasing force of the compression spring 63 as shown in FIGS. 8 and 9.

Within the ink valve accommodation chamber 58, an amount of space capable of accommodating ink therein is reduced by an amount equal to a volume of the inserted ink needle 111. As a result, an internal pressure (an ink pressure and an air pressure) of the ink valve accommodation chamber 58 increases. This rise in the internal pressure of the ink valve accommodation chamber 58 causes the valve member 61 to elastically deform such that the hemispherical section 69 closes the ink-flow passage 59, thereby preventing the ink within the ink valve accommodation chamber 58 from flowing back into the ink chamber 36. At this time, as shown by the broken line in FIG. 9, the film 33 covering the space 76 expands outward due to the increase in the internal pressure, enlarging the volume of ink valve accommodation chamber 58. The enlarged volume of the ink valve accommodation chamber 58 serves to absorb the rise in the internal pressure therewithin. In this way, the internal pressure within of the ink valve accommodation chamber 58, which has temporarily increased by the insertion of the ink needle 111, comes back to a normal level.

As described above, the film 33 can elastically deform so as to expand the volume of the ink valve accommodation chamber 58 that has increased due to the insertion of the ink needle 111. This configuration serves to suppress the rise in the internal pressure of the ink valve accommodation chamber 58, thereby preventing the ink from flowing out of the ink valve accommodation chamber 58 into the ink tube 20 through the ink needle 111. In this way, even when the sub tanks 28 are provided on the carriage 21, the ink is prevented from flowing into the sub tank 28 at the time of installation of the ink cartridge 30 and also from flowing back into the ink needle 111 as a reaction. Further, since the amount of ink flowing into the sub tank 28 is reduced, rise in pressure within the recording head 29 can also be reduced. Therefore, there arises a lower possibility that meniscus of the ink is destroyed at the recording head 29.

Further, the deformable wall of the ink cartridge 30 is realized by welding the film 33 to the periphery 77. Hence, the deformable wall can be obtained easily and at a lower cost.

Further, the deformable wall has the area largest among all the flat walls constituting the ink valve accommodation chamber 58 (or the secondary ink chamber). Therefore, changes in the volume of the ink valve accommodation chamber 58 can also be made large. That is, as the area of the deformable wall is greater, the expandable volume of the ink valve accommodation chamber 58 increases.

Further, the film 33 also serves to constitute a portion of the ink chamber 36. In other words, a single film (the film 33) can form the ink chamber 36 and the deformable wall of the ink valve accommodation chamber 58. Hence, the manufacturing process of the ink cartridge 30 can be simplified.

Next, an ink cartridge 130 according to a second embodiment of the present invention will be described with reference to FIGS. 10 through 12 wherein like parts and components are designated by the same reference numerals to avoid duplicating description.

The ink cartridge 130 according to the second embodiment is different from the ink cartridge 30 in that the ink cartridge 130 is provided with an ink buffer chamber 80, instead of the space 76. Therefore, a detailed configuration in the vicinity of the ink buffer chamber 80 only will be described.

Figure 10:
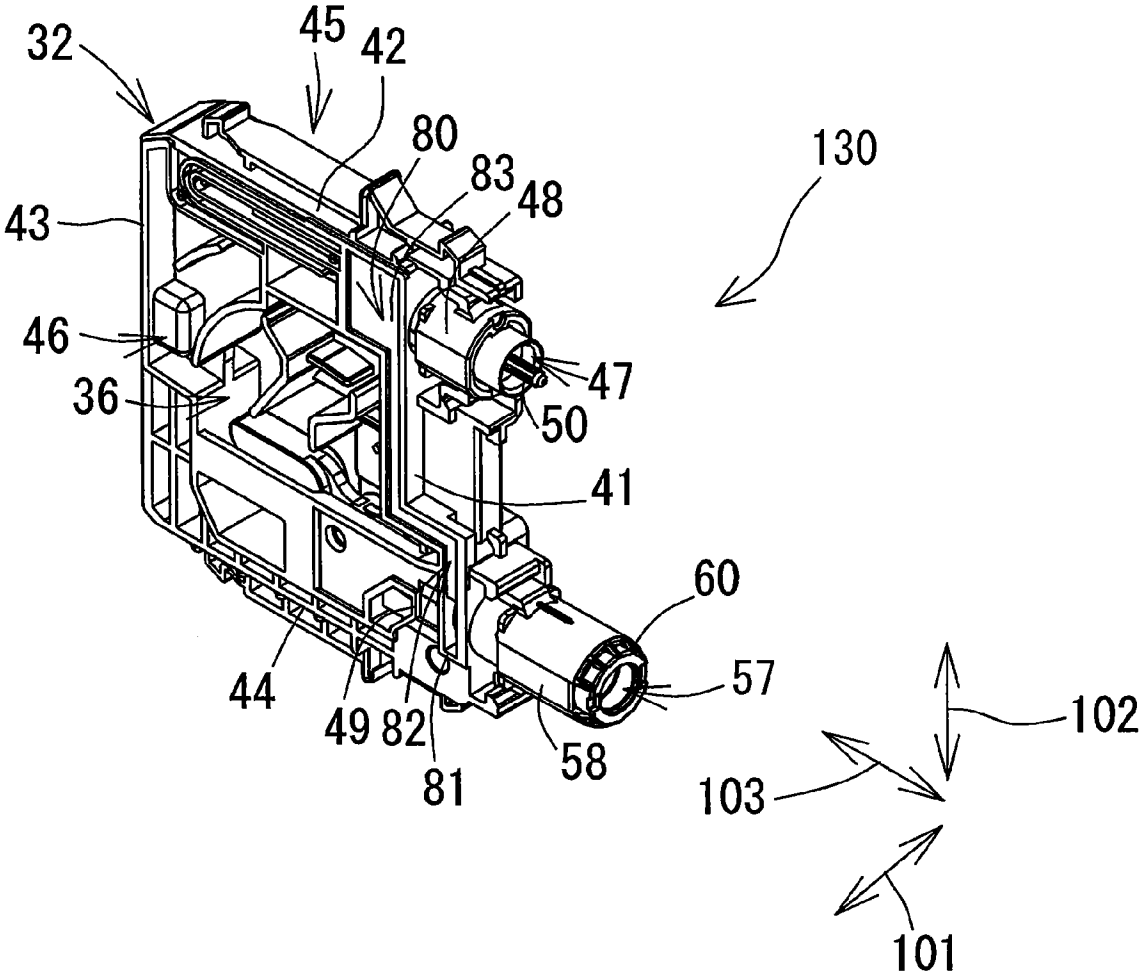
FIG. 10 is a perspective view showing an internal structure of an ink cartridge according to a second embodiment of the present invention.
Figure 11:
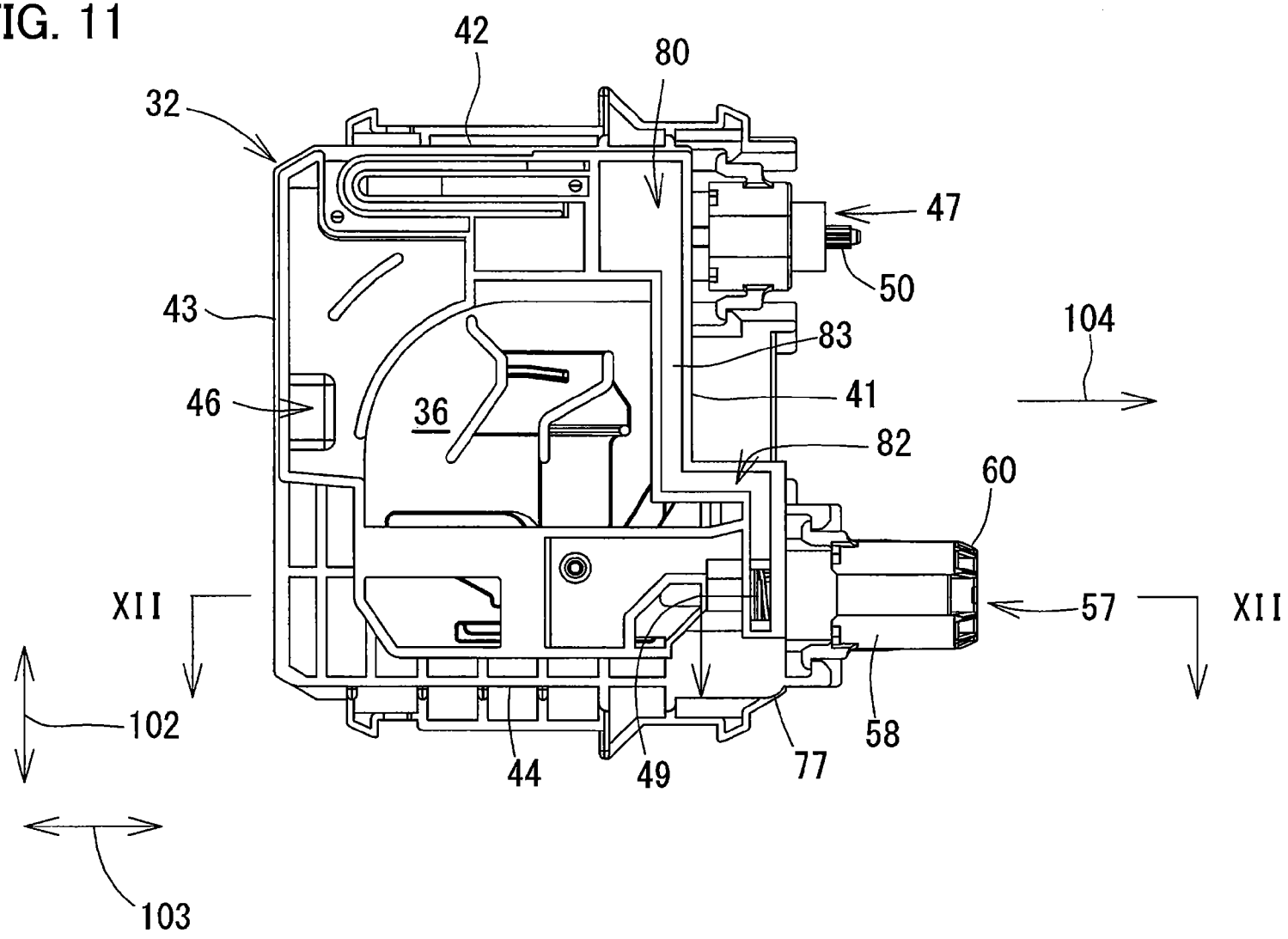
FIG. 11 is a right side view of the internal structure of ink cartridge according to the second embodiment.
Figure 12:
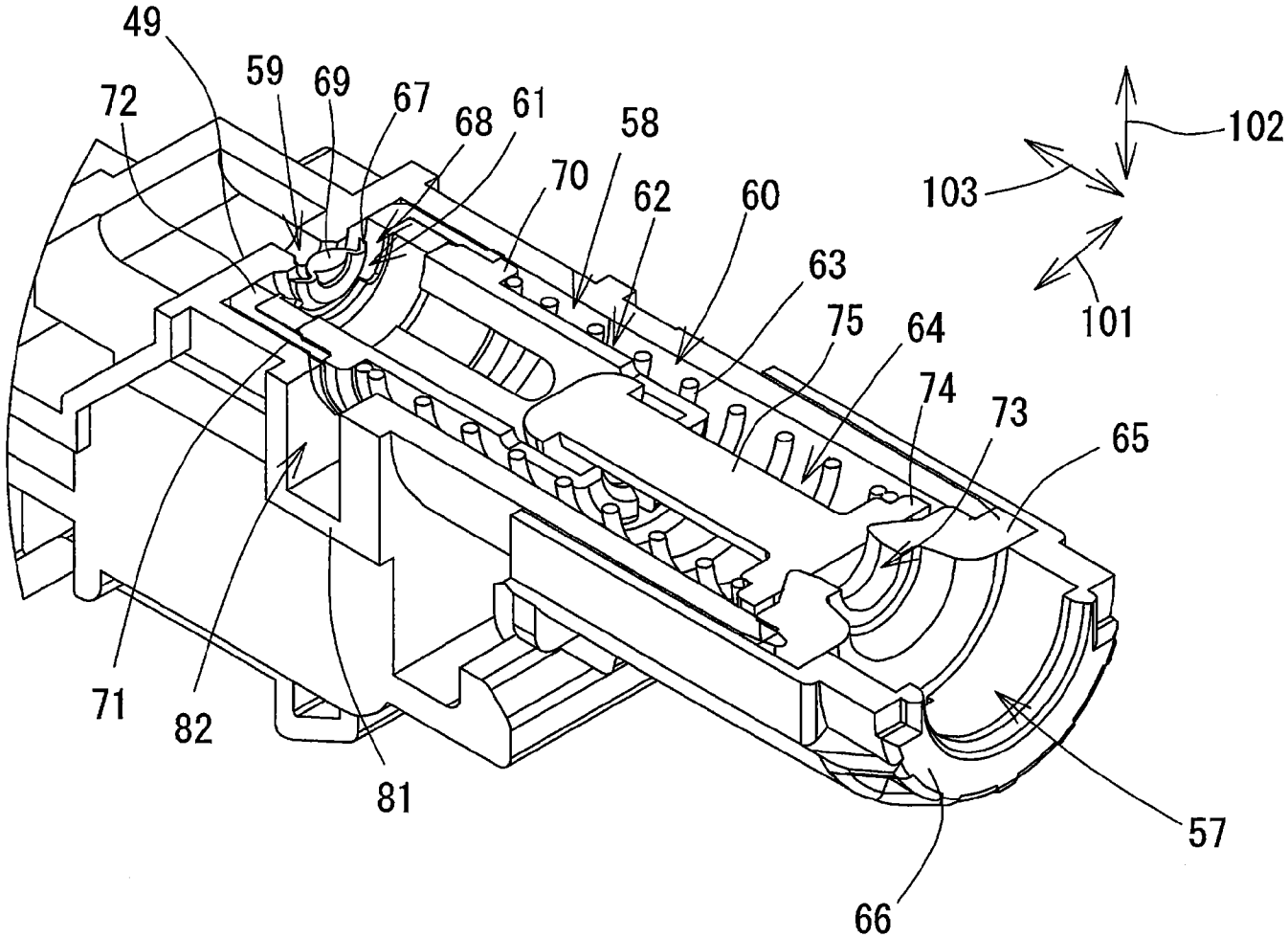
FIG. 12 is a partially enlarged perspective view of a cross-section of the ink cartridge according to the second embodiment taken along a plane including a line XII-XII shown in FIG. 11.

As shown in FIGS. 10 through 12, the ink valve accommodation chamber 58 is formed with a path 82 on the wall facing the right surface 46 of the frame 32. The path 82 extends upward from the ink valve accommodation chamber 58, bends toward the rear wall 43 and then extends upward up to a position above the ink chamber 36 where the path 82 is connected to the ink buffer chamber 80. The path 82 is formed with a periphery 81 extending along the path 82. The ink buffer chamber 80 and the periphery 81 constitute the right surface 46 together with the front wall 41, the upper wall 42, the rear wall 43 and the bottom wall 44. Although not shown in the drawings, the film 33 is attached to the periphery 81 by ultrasonic welding. In the second embodiment, a flat surface configured of the film 33 welded to the periphery 81 has an area greatest among other flat surfaces constituting the ink valve accommodation chamber 58. Being welded to the periphery 81, the film 33 is elastically deformable such that a volume of the ink buffer chamber 80 can expand, i.e., the film 33 can deform outward in the widthwise direction 101.

The ink buffer chamber 80 and the path 82 are filled with an ink absorbing member 83. The ink absorbing member 83 is made of a sponge or nonwoven fabric, for example, and serves to absorb and retain ink therein. Due to the existence of the ink absorbing member 83 within the ink buffer chamber 80 and the path 82, the ink flowing out of the ink valve accommodation chamber 58 can be absorbed and retained in the ink buffer chamber 80 and the path 82, thereby preventing the ink from flowing back into the ink valve accommodation chamber 58.

As in the first embodiment, when the ink needle 111 is inserted into the through-hole 73 upon installing the ink cartridge 130 into the cartridge case 110, the valve main body 64 is separated from the sealing member 65 against the biasing force of the compression spring 63. The ink needle 111 thus enters into the ink valve accommodation chamber 58.

At this time, an amount of space within the ink valve accommodation chamber 58 capable of accommodating ink therein is reduced by an amount equal to the volume of the inserted ink needle 111. As a result, the pressure (the ink pressure and/or the air pressure) within the ink valve accommodation chamber 58 increases. Due to the rise in the internal pressure of the ink valve accommodation chamber 58, the valve member 61 elastically deforms such that the hemispherical section 69 closes the ink-flow passage 59, preventing the ink from flowing into the ink chamber 36 from the ink valve accommodation chamber 58.

Concurrently, the increase in the internal pressure of the ink valve accommodation chamber 58 causes the ink to flow out of the ink valve accommodation chamber 58 toward the ink buffer chamber 80 via the path 82. The ink flowed out of the ink valve accommodation chamber 58 is, however, absorbed by the ink absorbing member 83 and retained therein. Also, the film 33 (partially constituting walls of the ink buffer chamber 80 and the path 82) can expand (elastically deform) outward so as to enlarge a volume of a space within the path 82 and the ink buffer chamber 80 into which the ink can flow from the ink valve accommodation chamber 58. As a result, the increased internal pressure of the ink valve accommodation chamber 58 returns to the normal level. The second embodiment can thus achieve technical effects the same as those of the first embodiment.

Further, the deformable wall of the ink buffer chamber 80 (the wall made of the film 33) is positioned above the ink chamber 36 in the upright posture. In other words, a portion of the ink buffer chamber 80 is disposed above a liquid surface of the liquid accommodated in the ink chamber 36. Therefore, within the ink buffer chamber 80, the film 33 is subject to less pressure from the ink. The change in the internal pressure of the ink valve accommodation chamber 58 can impose a greater impact on the deformation of the film 33.

While the invention has been described in detail with reference to the embodiments thereof, it would be apparent to those skilled in the art that various changes and modifications may be made therein without departing from the spirit of the invention.

For example, instead of the ink absorbing member 83 provided within the ink buffer chamber 80 and the path 82 in the second embodiment, a check valve may be provided within the path 82. Such check valve serves to allow ink to flow from the ink valve accommodation chamber 58 to the ink buffer chamber 80, but also to restrict ink from flowing into the ink valve accommodation chamber 58 from the ink buffer chamber 80.

What is claimed is:

1. An ink cartridge configured to be installed in a cartridge case, the ink cartridge comprising:

a first ink chamber configured to store ink therein;

a second ink chamber that is in fluid communication with the first ink chamber via a first path, the second ink chamber defining therein a volume;

an ink-flow check portion configured to allow the ink to flow from the first ink chamber to the second ink chamber and block the ink from flowing from the second ink chamber to the first ink chamber;

a pressure control portion configured to suppress an increase in an internal pressure of the second ink chamber; and an air communication portion configured to receive air external to the ink cartridge, wherein the pressure control portion comprises a deformable member, at least a portion of the second ink chamber being formed of the deformable member.

2. The ink cartridge as claimed in claim 1, wherein the pressure control portion is configured to operate to change the volume of the second ink chamber.

3. The ink cartridge as claimed in claim 2, wherein the at least a portion of the second ink chamber being formed of the deformable member is configured to deform such that the volume of the second ink chamber is enlarged when the internal pressure of the second ink chamber increases.

4. The ink cartridge as claimed in claim 3, wherein the deformable member is made of a film.

5. The ink cartridge as claimed in claim 4, wherein the second ink chamber is configured of a plurality of walls, the portion of the second ink chamber formed of the deformable member having an area greatest among areas of the plurality of walls.

6. The ink cartridge as claimed in claim 4, wherein the film comprises a portion of the first ink chamber.

7. The ink cartridge as claimed in claim 1, wherein the ink-flow check portion is disposed in the first path.

8. The ink cartridge as claimed in claim 1, wherein the ink-flow check portion comprises a check valve.

9. The ink cartridge as claimed in claim 1, wherein the pressure control portion comprises a third ink chamber that is in fluid communication with the second ink chamber via a second path.

10. The ink cartridge as claimed in claim 9, wherein the second path extends upward to a position above the first ink chamber.

11. The ink cartridge as claimed in claim 9, wherein the third ink chamber defines therein a volume and has at least a portion configured to deform such that the volume of the third ink chamber changes.

12. The ink cartridge as claimed in claim 11, wherein the deformable portion of the third ink chamber is made of a film.

13. The ink cartridge as claimed in claim 12, wherein the film constitutes a portion of the first ink chamber and a portion of the second ink chamber.

14. The ink cartridge as claimed in claim 9, further comprising an ink-flow blocking portion configured to permit the ink to flow from the second ink chamber to the third ink chamber and block the ink from flowing from the third ink chamber to the second ink chamber via the second path.

15. The ink cartridge as claimed in claim 14, wherein the ink-flow blocking portion is provided in the third ink chamber, the ink-flow blocking portion absorbing the ink flowing into the third ink chamber and retaining the absorbed ink within the third ink chamber.

16. The ink cartridge as claimed in claim 15, wherein the ink-flow blocking portion comprises a sponge provided within the third ink chamber.

17. An image recording apparatus comprising:

a cartridge case;

an ink cartridge including:

a first ink chamber configured to store ink therein;

a second ink chamber that is in fluid communication with the first ink chamber via a first path, the second ink chamber having an outlet port, and the second ink chamber defining therein a volume;

an ink-flow check portion configured to allow the ink to flow from the first ink chamber to the second ink chamber and block the ink from flowing from the second ink chamber to the first ink chamber;

a pressure control portion configured to suppress an increase in an internal pressure of the second ink chamber; and an air communication portion configured to receive air external to the ink cartridge;

a needle configured to be inserted into the outlet port of the second ink chamber;

a fourth ink chamber configured to store the ink flowing out of the second ink chamber via the needle, the fourth ink chamber defining therein a volume that is allowed to change in accordance with a change in an internal pressure of the fourth ink chamber; and a recording head to which the ink is supplied from the fourth ink chamber, wherein the pressure control portion comprises a deformable member, at least a portion of the second ink chamber being formed of the deformable member.

18. The image recording apparatus as claimed in claim 17, wherein the pressure control portion operates to change the volume of the second ink chamber.

19. The image recording apparatus as claimed in claim 18, wherein the at least a portion of the second ink chamber being formed of the deformable member is configured to deform such that the volume of the second ink chamber is enlarged when the internal pressure of the second ink chamber increases.

20. The image recording apparatus as claimed in claim 19, wherein the deformable member is made of a film.

21. The image recording apparatus as claimed in claim 17, wherein the pressure control portion comprises a third ink chamber that is in fluid communication with the second ink chamber via a second path.

22. The image recording apparatus as claimed in claim 21, wherein the second path extends upward to a position above the first ink chamber.

23. The image recording apparatus as claimed in claim 21, wherein the third ink chamber defines therein a volume and has at least a portion configured to deform such that the volume of the third ink chamber changes.

24. The image recording apparatus as claimed in claim 23, wherein the deformable portion of the third ink chamber is made of a film.

* * * * *